US005573604A

United States Patent [19]

Gerdes

[11] Patent Number: 5,573,604

[45] Date of Patent: Nov. 12, 1996

[54] PROCESS FOR MANUFACTURING A TURBINE BLADE MADE OF AN (ALPHA/BETA)-TITANIUM BASE ALLOY

[75] Inventor: Claus Gerdes, Baden-Rütihof, Switzerland

[73] Assignee: ABB Management AG, Baden, Switzerland

[21] Appl. No.: 496,188

[22] Filed: Jun. 28, 1995

[30] Foreign Application Priority Data

Aug. 17, 1994 [EP] European Pat. Off. ..... 94112802

[51] Int. Cl.[6] ..... C23C 8/20

[52] U.S. Cl. ..... 148/237; 148/210; 148/212; 148/217; 148/219; 148/224

[58] Field of Search ..... 148/210, 212, 148/217, 219, 224, 237, 669

[56] References Cited

U.S. PATENT DOCUMENTS

| | | | |
|---|---|---|---|
| 5,141,574 | 8/1992 | Takahashi et al. | 148/237 |
| 5,330,587 | 7/1994 | Gauigan et al. | 148/212 |
| 5,413,641 | 5/1995 | Coulon | 148/224 |

FOREIGN PATENT DOCUMENTS

| | | | |
|---|---|---|---|
| 0491075A1 | 6/1992 | European Pat. Off. . | |
| 289293 | 4/1991 | Germany | 148/224 |
| 57-198259 | 12/1982 | Japan | 148/224 |
| 4-41662 | 2/1992 | Japan | 148/212 |

*Primary Examiner*—John Sheehan
*Attorney, Agent, or Firm*—Burns, Doane, Swecker & Mathis

[57] ABSTRACT

The process serves for the manufacture of an erosion-resistant turbine blade which is preferably used in the low-pressure stage of a steam turbine and is made of a vanadium-containing (α/β)-titanium base alloy. This involves the formation, by remelt alloying of a blade section which is situated in the region of the blade tip and comprises the leading edge of the blade, in a boron-, carbon- and/or nitrogen-containing gas atmosphere, with the aid of a high-power energy source, of an erosion-resistant protective layer made of a titanium boride, titanium carbide and/or titanium nitride. The remelt alloyed blade section is subjected to a heat treatment at a temperature between 600° and 750° C. with the formation of a vanadium-rich β-titanium phase. As a result of the heat treatment and the attendant microstructural change, the fatigue strength of the turbine blade in the region of the protective layer is considerably improved while the erosion resistance of the untreated protective layer is virtually retained.

20 Claims, 2 Drawing Sheets

PROCESS FOR MANUFACTURING A TURBINE BLADE MADE OF AN (ALPHA/BETA)-TITANIUM BASE ALLOY

BACKGROUND OF THE INVENTION

1. Field of the Invention

The invention is based on a process for manufacturing an erosion-resistant turbine blade made of an (α/β)-titanium base alloy made by remelt alloying a tip of a blade section using a B-, C- and/or N- containing gas atmosphere with the aid of a high power energy source. A blade manufactured in accordance with such a process is preferably employed in low-pressure stages of steam turbines, since owing to its low density it meets, even if overall lengths are large, the specifications with respect to mechanical loadability at temperatures up to approximately 150° C. In this temperature range the steam entering the turbine contains droplets which impinge at a high velocity on those faces of the turbine blade which are exposed to the incoming steam, in particular the leading edge of the blade and the blade surface sections adjoining the leading edge of the blade on the suction side. In the process,, the droplets may cause erosion damage. Particularly subject to wear and tear is the blade section situated in the region of the blade tip, since there the circumferential speed of the blade is largest.

2. Discussion of Background

A process of the type mentioned at the outset is described in EP-A-0 491 075. This process serves to produce a protective layer having high erosion resistance on a turbine blade made of an (α/β)-titanium base alloy in the region of the blade tip. In this case, the protective layer is generated by remelt alloying of the (α/β)-titanium base alloy at the surface in a boron-, carbon- or nitrogen-containing gas atmosphere by means of a laser. Such a layer has great hardness, compared with the untreated regions of the blade, and effectively protects the titanium base alloy situated underneath it against droplet erosion. It has been found, however, that a blade material protected against erosion in such a way has lower fatigue strength than the unprotected blade material.

SUMMARY OF THE INVENTION

Accordingly, one object of the invention is to provide a novel process of the type mentioned at the outset, which process enables the manufacture, in a cost-effective manner suitable for mass production, of an erosion-resistant turbine blade which is distinguished by a long service life even when subject to constantly fluctuating loads.

The process according to the invention provides, in a few readily performable process steps, that is to say a surface treatment of the unprotected (α/β)-titanium base alloy by remelt alloying by means of a high-power energy source, followed by a heat treatment, a turbine blade which is distinguished, in the region of its blade tip, both by high erosion resistance and by good fatigue strength.

While the advantage of erosion resistance is essentially elicited by remelt alloying in a suitable gas atmosphere, what prevents the formation of undesirable cracks in the protective layer in the case of external stresses being present, and thus premature fatigue of the material is a heat treatment at temperatures between 600° and 750° C. At these comparatively low temperatures, quite considerable microstructural changes occur in the remelt alloyed protective layer, but not in the adjoining region of the unaffected (α/β)-titanium base alloy.

Microstructural changes having a particularly beneficial effect on fatigue strength occur if the heat treatment is carried out at temperatures between 650° and 700° C. If the heat treatment is carried out over at least one hour, preferably between 2 and 6 hours, diffusion processes give rise to homogenization between the α-stabilized phases. At the same time, recrystallization takes place in the remelt alloyed protective layer and in the heat-affected zone of the (α/β)-titanium base alloy adjoining it, grain sizes involving a diameter between 20 and 100 μm being produced in the process. Particular significance, however, attaches to the occurrence of uniformly distributed vanadium-rich β-precipitates. This is probably particularly promoted by the low solubility of vanadium in α-titanium.

The fatigue strength may additionally be improved by mechanical strengthening, especially by controlled shot peening, of the heat-treated blade section.

A further improvement in the fatigue strength can be achieved if the remelt alloying is carried out in a gas atmosphere which, in addition to a boron-, carbon- and/or nitrogen-containing gas contains an inert carrier gas, the ratio of the partial pressures of carrier gas to boron-, carbon- and/or nitrogen-containing gas being at least 2:1, preference being given to a gas atmosphere in which the ratio is greater than 2:1 and at most 4:1 and in which the gases used are noble gas such as, in particular, argon, and nitrogen.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein the two FIGS. 1 and 2 each show a diagram in which the erosion resistance and the fatigue strength, respectively, of blade sections which had been manufactured according to the prior art are compared with the erosion resistance and the fatigue strength, respectively, of blade sections which had been manufactured according to the process of the invention.

DESCRIPTION OF THE PREFERRED EMBODIMENTS

Figure 1:
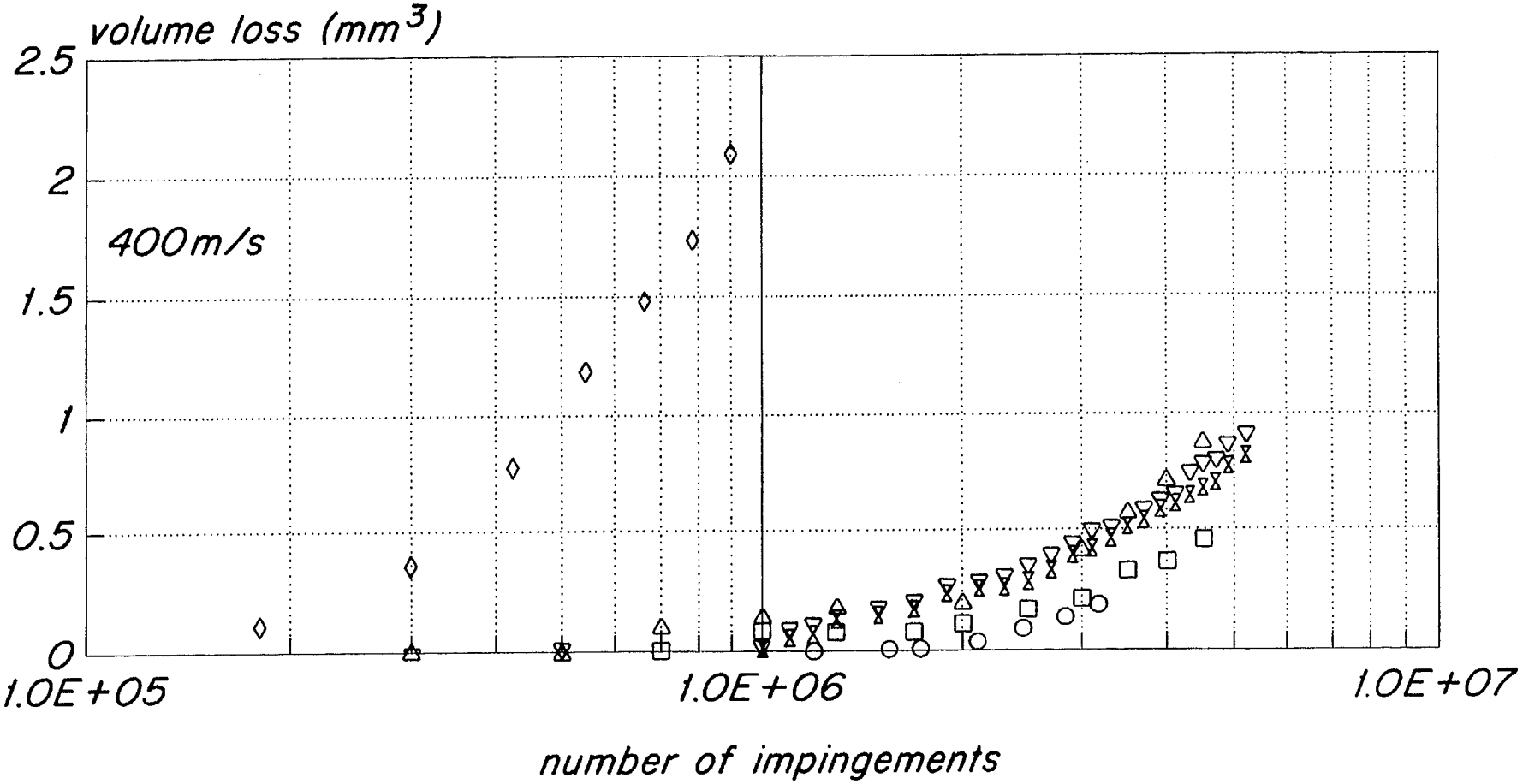

As described in the prior art in accordance with EP-A0491075, the uncoated turbine blade is supported on a horizontally displaceable supporting table. The blade tip is exposed, in the region of the leading edge of the blade, to an oxygen-free .boron, carbon- and/or nitrogen-containing gas atmosphere and at the same time irradiated with a high-power energy source, in particular with a laser.

In a preferred embodiment, the turbine blade was made of a titanium base alloy comprising 6% by weight of aluminum and 4% by weight of vanadium (Ti-6A1-4V, and a $CO_2$ gas laser having an output of 1.5 kW and an energy spectrum conforming to a Gaussian distribution was used. The preferred width of the laser beams was 1.3 mm. The melt traces formed on the blade surface during remelt alloying overlapped to approximately 50% and had a melting depth of approximately 0.5 mm. The gas atmosphere contained nitrogen and argon and, in the form of a gas stream, was directed at the incidence point of the laser at the blade surface, a jet-like nitrogen stream being enclosed in an argon stream. It was thus possible for oxygen and other undesirable substances to be kept away from the incidence point and thus from the remelt alloying process. The nitrogen uptake during remelt alloying depended on the partial pressure of the nitrogen in the gas stream. The ratio of the partial pressures of argon to nitrogen was varied between 2:1 and 4:1.

During the radiation, the laser was moved along meandrous tracks with respect to the turbine blade, that part of the surface of the (α/β)-titanium base alloy, which was situated in the incidence point, being fused and the melt being alloyed with nitrogen which together with the titanium of the fused base alloy formed hard titanium nitride. Given a suitable composition of the gas supplied it would correspondingly likewise be possible for titanium boride and/or titanium carbide to be formed.

On the basis of X-ray diffraction diagrams, microhardness measurements, scanning electron microscopy and transmission electron microscopy studies and microprobe analyses λ it was found that the protective layer formed in the process, which typically had a thickness between 0.4 and 1 mm, essentially comprises titanium nitrides which are embedded in a matrix of α-titanium. The morphology and distribution of the titanium nitrides depend on the process parameters during remelt alloying and on the nitrogen concentration in the gas atmosphere. Depending on the nitrogen concentration in the gas atmosphere, the titanium nitride may be laminar or dendritic in character. The protective layer formed may, depending on the remelt alloying conditions, have a Vickers hardness of from 600 to 800 HV, compared with a Vickers hardness of from 350 to 370 HV of the (α/β)-titanium base alloy.

A blade material thus produced, the protective layer having been polished, was used to measure the erosion resistance and fatigue strength.

The measurement of the erosion resistance was carried out in a test machine which essentially comprised a rotating twin arm, rectangular specimens of the blade material to be tested being attached to the free end of said arm. The twin arm was disposed in a chamber which was evacuated to approximately 25 mbar, so that air friction was avoided and high speeds could be achieved. Disposed on the perimeter of the chamber there was a droplet generator which generated three jets comprising water droplets of equal size in each case. The water droplets impinged perpendicularly on the surface of the specimens. The intensity of each impingement was defined by the magnitude of the circumferential speed of the rotating arm at the impingement location. The droplets generated by the generator typically had a diameter of approximately 0.2 mm. The circumferential speed of the arm at the location of the specimen to be studied was constant and between specimens varied between 300 and 500 m/s. As a measure for the erosion resistance, the volume loss [$mm^3$] of the specimen studied was determined as a function of the number of impinging droplets at a given circumferential speed (FIG. 1).

Figure 2:
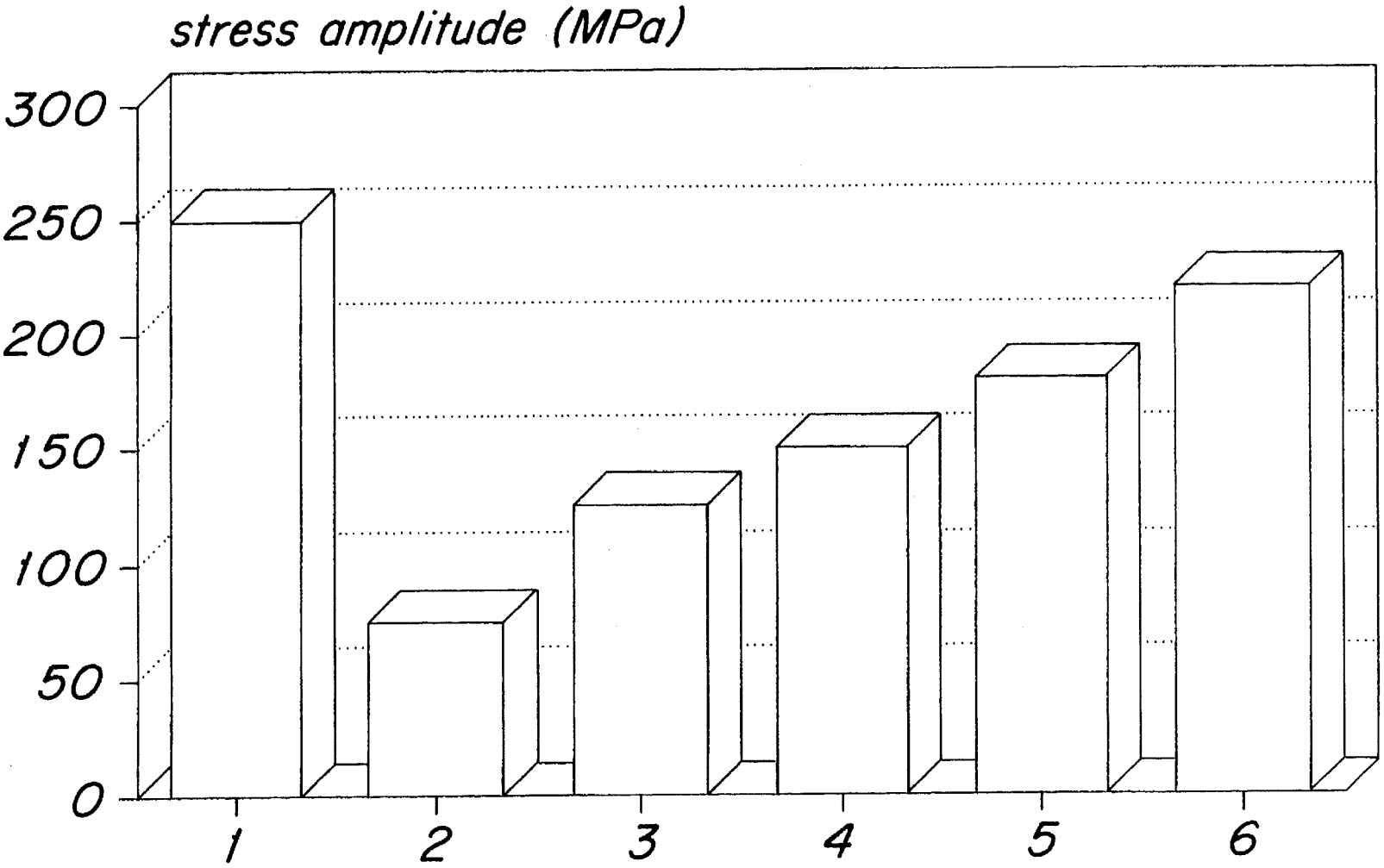

To measure the fatigue strength, the specimen was subjected to alternating bending in a servo-hydraulic testing machine under four-point bending conditions with a frequency of 30 Hz and at a stress ratio R ($\sigma_{min}/\sigma_{max}$) of 0.2 over $10^7$ cycles. The maximum stress amplitude $\sigma_{max}$ [MPa] thus determined which the sample could absorb without breaking was used as a measure for the fatigue strength (FIG. 2).

FIG. 1 shows that the (α/β)-titanium base alloy, compared with the protective layer produced by remelt alloying with a ratio of the partial pressures of argon to nitrogen of 2:1, has very low erosion resistance. In FIG. 1, ○ represents a TiN protective layer wherein the remelt alloying is carried out with a ratio of partial pressures of argon to nitrogen ($Ar/N_2$ ratio) of 2:1, □ represents a TiN protective layer wherein the remelt alloying is carried out with the $Ar/N_2$ ratio of 4:1 and the layer is subjected to a heat treatment at 650° C. for 4 hours, ◇ represents an untreated Ti-6A1-4V alloy, X represents a TiN protective layer produced by remelt alloying with the $Ar/N_2$ ratio of 4:1 and heat treatment at 700° C. for 4 hours, Δ represents a TiN protective layer produced by remelt alloying with the $Ar/N_2$ ratio of 2:1 and heat treatment at 650° C. for 4 hours and ▽ represents a TiN protective layer produced by remelt alloying with the $Ar/N_2$ ratio of 2:1 and heat treatment at 700° C. for 4 hours.; The untreated (α/β)-titanium base alloy is considerably more ductile and is plastically deformed by the impinging water droplets. Consequently, erosion craters are formed at a very early stage, which are subsequently superimposed on one another and finally lead to cracks or cause lamellar regions to become detached. In contrast, the protective layer formed by remelt alloying has great hardness and thus largely prevents the undesirable cratering. The great hardness and correspondingly the low ductility of the protective layer does, however, cause a decrease in the fatigue strength of the protective layer, compared with the (α/β)-titanium base alloy, by approximately 70% (FIG. 2). In FIG. 2, column 1 represents a base material of Ti-6A1-4V, column 2 represents specimen A nitrided with the $Ar/N_2$ ratio of 2:1 and in a polished condition, column 3 represents specimen A in a nitrided, polished and shot peened condition, column 4 represents specimen A in a nitrided, heat treated at 650° C. for 4 hours, polished and shot peened condition, column 5 represents specimen B nitrided with the $Ar/N_2$ ratio of 4:1 and in a heat treated at 650° C. for 4 hours, polished and shot peened condition, and column 6 represents specimen B in a nitrided, heat treated at 650° C. for 4 hours, polished and shot peened (at a higher intensity than the specimen shown in column 5) condition.

To improve the fatigue strength of the protective layer, the coated blade section was heat treated for 4 h at temperatures between 650° and 700° C. As well as to homogenization and recrystallization of the microstructure of the protective layer and the heat-effected zone, this gave rise, in particular, to vanadium-rich and uniformly distributed B-precipitates being formed in the alloyed protective layer. As can be seen from FIGS. 1 and 2, these microstructural changes result in an improvement of the fatigue strength of the protective layer by approximately from 10 to 15% (specimen A in FIG. 2) while maintaining the erosion resistance of the protective layer not heat-treated.

A further improvement in the fatigue strength while virtually maintaining the erosion resistance of the protective layer not heat-treated was additionally achieved by mechanical strengthening of the heat-treated protective layer by means of controlled shot peening. Typical values for the shot peening process employed were a shot diameter of 0.3 and compressed-air pressures) to accelerate the shot) of from 3 to 5 bar. By means of Almen intensities of 0.2 mmA it was thus possible to double the fatigue strength of the protective layer, compared with the protective layer not subjected to heat treatment or shot peening.

A further improvement in the fatigue strength of the protective layer while maintaining the good erosion resistance of the protective layer not heat-treated was also achieved by the ratio of the partial pressures of argon to nitrogen in the gas atmosphere being greater than 2:1 and being around 4:1. As is demonstrated by Example B from FIG. 2, this measure provided for an increase in the fatigue strength, compared with the likewise heat-treated protective layer according to Example A, by approximately 20% (FIGS. 1 and 2).

It is particularly advantageous, with respect to high fatigue strength of the microstructure, for the shot peening to be carried out with at least two-fold complete coverage. Furthermore, it is extremely beneficial for an intensity during controlled shot peening to be selected which is greater than 0.2 and less than 0.45 mm A. By means of shot peening with an Almen intensity of approximately 0.3 mm A it was possible to improve the fatigue strength of the protective layer in accordance with Example B, compared with the corresponding protective layer which had, however, only been strengthened by means of shot peening at an Almen intensity of 0.2 mmA, by approximately 15–20%, which provided a protective layer which has virtually the same erosion resistance as the untreated protective layer and which, at the same time, achieves approximately 85% of the fatigue strength of the titanium base alloy (FIG. 2).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for manufacturing an erosion-resistant turbine blade made of a vanadium-containing (α/β)-titanium base alloy by remelt alloying a blade section, which is situated in the region of the blade tip and comprises the leading edge of the blade, in a boron-, carbon- and/or nitrogen-containing gas atmosphere with the aid of a high-power energy source, a protective layer being formed which is made of a material which is more erosion-resistant than the titanium base alloy and is based on a titanium boride, titanium carbide and/or titanium nitride, which process comprises the remelt alloyed blade section being subjected to a heat treatment at a temperature between 600° and 750° C. with the formation of a vanadium-rich β-titanium phase.

2. The process as claimed in claim 1, wherein the heat treatment is carried out between 650° and 700° C.

3. The process as claimed in claim 1, wherein the heat treatment is carried out for at least 1 h.

4. The process as claimed in claim 3, wherein the heat treatment is carried out for from 2 to 6 h.

5. The process as claimed in claim 1, wherein the heat-treated blade section is mechanically strengthened.

6. The process as claimed in claim 5, wherein the blade section is subjected to controlled shot peening.

7. The process as claimed in claim 6, wherein said shot peening is carried out with at least a two-fold complete overlap.

8. The process as claimed in claim 6, wherein said shot peening is carried out with an Almen intensity greater than 0.2 and smaller than 0.45 mmA.

9. The process as claimed in claim 1, wherein the gas atmosphere, in addition to the boron-, carbon- and/or nitrogen-containing gas contains a carrier gas, the ratio of the partial pressures of carrier gas to boron-, carbon- and/or nitrogen-containing gas being at least 2:1.

10. The process as claimed in claim 9, wherein the gas atmosphere contains nitrogen and noble gas, in particular argon, the ratio of the partial pressures of noble gas to nitrogen being greater than 2:1 and smaller than 4:1.

11. A process for manufacturing an erosion-resistant turbine blade having a blade tip and made of a vanadium-containing (α/β)-titanium base alloy, comprising forming a protective layer by remelt alloying a leading edge of the blade situated in the region of the blade tip, the remelt alloying comprising melting the leading edge with a beam of energy from a high-power energy source while contacting the leading edge with a boron-, carbon- and/or nitrogen-containing gas atmosphere, the protective layer including titanium boride, titanium carbide and/or titanium nitride, the process further comprising subjecting the protective layer to a heat treatment at a temperature between 600° and 750° C. and forming a vanadium-rich β-titanium phase in the protective layer.

12. The process as claimed in claim 11, wherein the heat treatment is carried out between 650° and 700° C.

13. The process as claimed in claim 11, wherein the heat treatment is carried out for at least 1 hour.

14. The process as claimed in claim 13, wherein the heat treatment is carried out for from 2 to 6 hours.

15. The process as claimed in claim 11, wherein the heat-treated blade section is subjected to mechanical working.

16. The process as claimed in claim 15, wherein the blade section is subjected to controlled shot peening.

17. The process as claimed in claim 16, wherein said shotpeening is carried out with an Almen intensity greater than 0.2 and smaller than 0.45 mm A.

18. The process as claimed in claim 11, wherein the gas atmosphere, in addition to the boron-, carbon- and or nitrogen-containing gas contains a carrier gas, the ratio of the partial pressures of carrier gas to boron-, carbon- and/or nitrogen-containing gas being at least 2:1.

19. The process gas as claimed in claim 11, wherein the high-power energy source comprises a laser and the gas atmosphere comprises a gas stream directed at a point of contact of the beam of energy with the leading edge.

20. The process gas as claimed in claim 11, wherein the remelt alloying forms titanium nitride particles embedded in a matrix of α-titanium.

* * * * *